United States Patent [19]

Schenk et al.

[11] 4,174,569

[45] Nov. 20, 1979

[54] ELECTRIC RAZOR

[76] Inventors: Hans Schenk, Stadlgasse 6, Graz, Austria, A-8020; Maria Sprung; Walter Sprung, both of Schiesstattgasse 5/6/23, Graz, Austria, A-8010

[21] Appl. No.: 881,081

[22] Filed: Feb. 24, 1978

[30] Foreign Application Priority Data

Feb. 25, 1977 [AT] Austria ..... 1264/77

[51] Int. Cl.[2] ..... B26B 19/26

[52] U.S. Cl. ..... 30/43.3; 30/43.7

[58] Field of Search ..... 30/42, 43.3, 43.7, 43.8, 30/43.91

[56] References Cited

U.S. PATENT DOCUMENTS

| | | | |
|---|---|---|---|
| 2,260,114 | 10/1941 | Hammond | 30/43.8 |
| 2,331,501 | 10/1943 | Rand | 30/43.91 |
| 2,347,869 | 5/1944 | Amdur | 30/43.91 |
| 2,998,648 | 9/1961 | Barron | 30/43.3 X |
| 3,156,045 | 11/1964 | Godefroy | 30/43.3 |

FOREIGN PATENT DOCUMENTS

| | | | |
|---|---|---|---|
| 982844 | 1/1951 | France | 30/42 |
| 363259 | 8/1962 | Switzerland | 30/43.91 |

*Primary Examiner*—Gary L. Smith

*Attorney, Agent, or Firm*—Townsend and Townsend

[57] ABSTRACT

An electric razor is disclosed which comprises a housing having a shearing head, a shearing comb disposed within the head and having openings permitting hair protruding from a surface to enter into an interior of the comb, and a blade beam carrier which mounts an elongated blade beam and which is oscillated relative to the comb for severing hair extending through the comb openings. A connecting member driven by an electric motor engages and oscillates the blade beam. A reduction drive is provided for oscillating the shearing comb at a lesser frequency than the blade beam in generally three directions, a first direction substantially parallel to the oscillating direction of the blade beam, a second direction which is transverse thereto, and a third direction which lifts the shearing comb off the skin being shaved.

12 Claims, 4 Drawing Figures

ELECTRIC RAZOR

The present invention refers to an electric razor of the type being used for removing human beard. Such electric razors comprise a housing or casing with which is connected a cutter head accommodating a blade beam carrier connected to an elongated blade beam and further comprise a shearing comb cooperating with the blade beam and provided with openings allowing the hairs of the beard to enter.

As a rule, only the blade beam carrier and the blade beam carried by the blade beam carrier are being oscillated by the electric drive means provided within the housing or casing. It is also known to oscillate both, the blade beam carrier together with the blade beam and the shearing comb cooperating with the blade beam. In a known construction, the shearing comb is being moved in parallel direction relative to the movement of the blade beam carrier thus increasing the number of cut beard hairs as compared with an electric razor provided with a stationary shearing comb. In another known construction, the shearing comb is being moved in transverse direction relative to the direction of movement of the blade beam carrier, thus facilitating grasping of hairs protruding from the skin in an inclined direction. Finally there has been proposed a construction in which the shearing comb is not only put into an oscillating movement but is also lifted off the skin with a frequency equal to the frequency of its oscillation which measure shall avoid that the hairs of the beard are being bent by the shearing comb and thus evade from becoming shaved. All these known electric razors suffer from the drawback that they must be provided with drive means requireing a greater housing or casing than an electric razor provided with a stationary shearing comb and that the shearing comb, which according to common practice is formed of a very thin perforated foil, becomes subjected to such severe stress, that it becomes useless after an only short time of operation. The last mentioned drawback results from the high oscillating frequency of the shearing comb of known electric razors so that the shearing comb formed by a thin perforated foil can not withstand the high accelerating and decelerating forces.

It is an object of the present invention to provide an electric razor in which the blade beam carrier as well as the shearing comb are being subjected to an oscillating movement and to design the drive means in such a manner that it can be accommodated within a usual housing or casing of an electric razor.

It is a further object of the present invention to design the drive means for the shearing comb such that the shearing comb is capable of withstanding the occurying stresses during a long time of operation.

It is a further object of the present invention to provide an electric razor in which the oscillating movement of the shearing comb is of substantially lower frequency than is the frequency of the oscillating movement of the blade beam carrier.

It is a still further object of the present invention to provide an electric razor in which the shearing comb is subjected to an oscillating movement in longitudinal direction of the blade beam as well as in transverse direction thereto and additionally to an oscillating movement by which the shearing comb becomes periodically lifted off the skin.

The above mentioned objects and further objects of the present invention will appear more clearly from the following description made in connection with the accompanying drawings in which like reference numerals refer to similar parts throughout the several views and in which.

Figure 3:
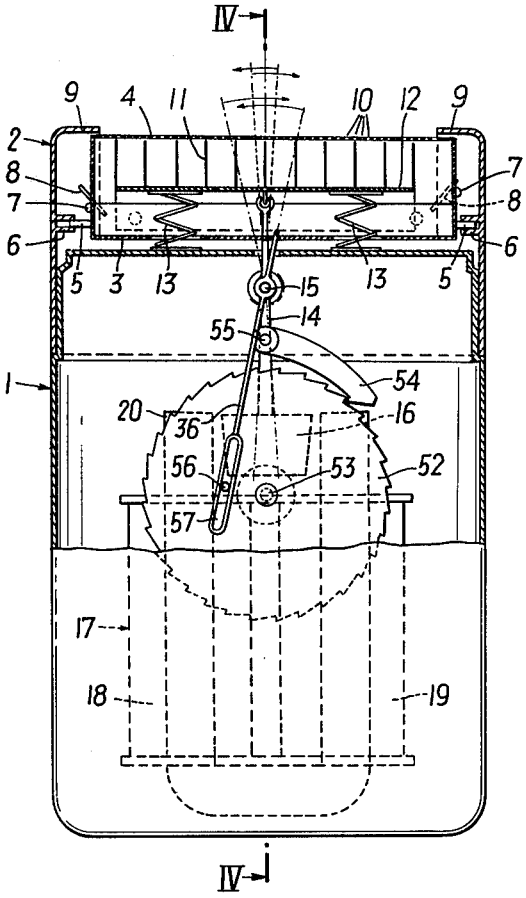
FIG. 3 is a longitudinal section through a third embodiment of an electric razor according to the invention.

The electric razor according to the invention comprises a housing or casing 1 and a shearing head 2 removably connected thereto. A frame 3 is arranged within the shearing head 2 and carries a shearing comb 4 formed of a perforated foil. The frame 3 is provided with pins 5 protruding into guide members 6 (FIG. 3). The guide members 6 protrude inwardly from opposing side walls of the shearing head 2. This manner of supporting the frame 3 makes it possible that the shearing comb can oscillate in its longitudinal direction, can rotate transversely to its longitudinal direction and additionally can become lifted off the skin, on which the hairs of the beard are growing, in an oscillating manner. This triple motion, which guarantees an optimum result of the shaving operation, is effected by abutments 7 provided in the interior of the shearing head 2 and cooperating with guide surfaces 8 of the frame 3. The guide surfaces 8 and the abutments 7 are designed such that when driving the shearing comb 4 for oscillating in its longitudinal direction, the frame 3, and therewith also the shearing comb 4, oscillate transversely to its longitudinal. This transverse oscillation of the frame and the shearing comb periodically lifts the latter off the skin because the pins 5 are arranged in the lower portion of the frame 3. The frame 3 pivots in the transverse direction about pins 5 and during such pivotal movement it induces a similar, transverse deflection of the shearing comb which, in effect, causes a periodic shifting of portions of the comb contacted by the frame towards and away from the skin.

The shearing head 2 is provided at its upper end with inwardly bent portions 9 extending in direction to the center of the shearing head and overlapping the edge portions of the shearing comb 4 so that the skin of the person using the electric razor can not become injured.

Figure 4:
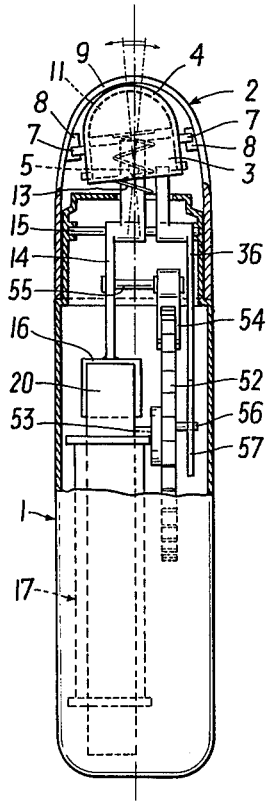
FIG. 4 is a cross-section taken on line IV—IV of FIG. 3.

The shearing comb 4 has its upper side vaulted as is shown in FIG. 4 and is provided with openings 10 through which protrude the hairs of the beard. The inner side of the shearing head 4 is cooperating with an elongated blade or knife or cutter or blade beam 11 fixed to a carrier therefor, later called blade beam carrier 12 only, and being pressed by springs 13 against the inner side of the shearing comb 4. The blade beam 11 comprises a plurality of cutting edges and is designed as usual for vibratory electric razors. The cutting edges are cooperating with the shearing comb and are cutting off those beard hairs which protrude through the openings 10 which are arranged in a plurality of rows. The blade beam 11 is driven for oscillating in its longitudinal direction.

The blade beam 11 is driven by a lever 14 carrying on opposite sides axle pins 15 which are pivotally supported within bearings of the housing 1. One end of this lever 14 is connected to the blade beam carrier 12 whereas its other end is carrying an armature body 16 being a component part of a swinging lever drive 17. The swinging lever drive 17 comprises two coils 18 and 19 being arranged on a magnetic core 20. The ends of the magnetic core 20 protrude into the area of movement of the armature body 16 so that on feeding the swinging lever drive 17 with alternating current, the lever 14 is imparted an oscillating movement which is transmitted to the blade beam 11 via the blade beam carrier 12. Thus, the blade beam 11 is driven for oscillating in longitudinal direction.

The lever 14 comprises a pivot pin 21 on which a connecting rod 22 is pivotally supported. That end of the connecting rod 22 which is opposed to the pivotal pin 21 is pivotally arranged on a crank pin 23 of a crank 24 which is fixed to a shaft 25 which in its turn is pivotally supported within the housing 1. A gear wheel 26 is non-rotatably connected to the shaft 25 and in engagement with a gear wheel 27 non-rotatably connected to a shaft 28. The shaft 28 is supported within the housing 1. A further gear wheel 29 is fixed to the shaft 28 and has a smaller diameter than is the diameter of the gear wheel 27 and is meshing with a gear wheel 30 non-rotatably fixed to a shaft 31. The shaft 31 is rotatably supported within the housing 1 and non-rotatably connected to a crank 32. The crank 32 has a crank pin 33 pivotally carrying one end of a connecting rod 34. The other end of the connecting rod 34 is pivotally connected to a pivot pin 35 which is arranged on a lever 36 in its turn equally arranged for pivotal movement around axle 15. The free end of the lever 36 is engaging a recess 37 provided within the frame 3 for the shearing comb 4.

Thus, the shearing comb is, by the arrangement described, driven for an oscillating movement, the frequency of which is in view of the reduction gear comprising the gear wheels 26, 27, 29, 30, substantially smaller than the frequency of the oscillating movement of the blade beam carrier 12.

Figure 1:
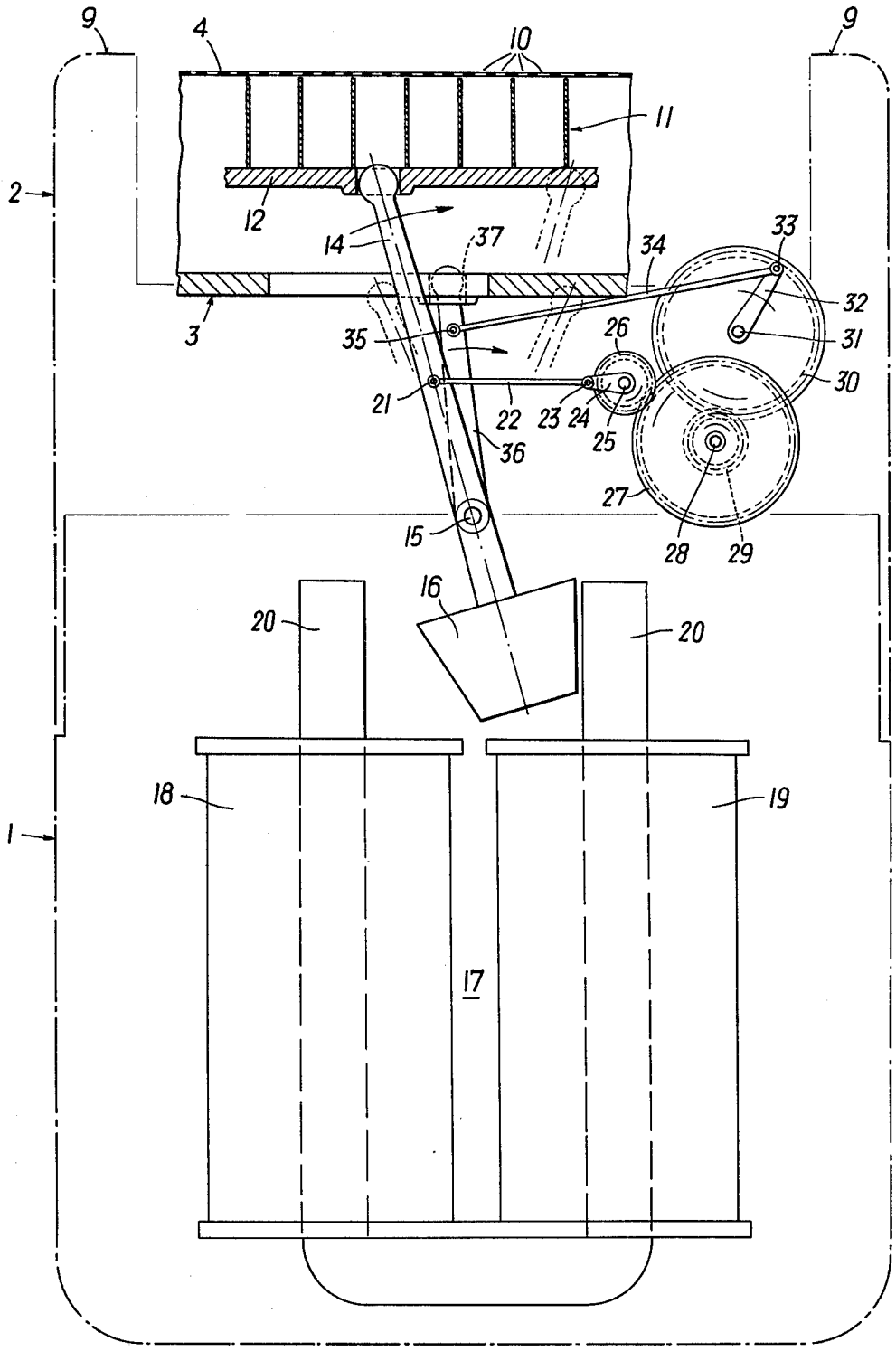
FIG. 1 is a longitudinal section through a first embodiment of an electric razor according to the invention.
Figure 2:
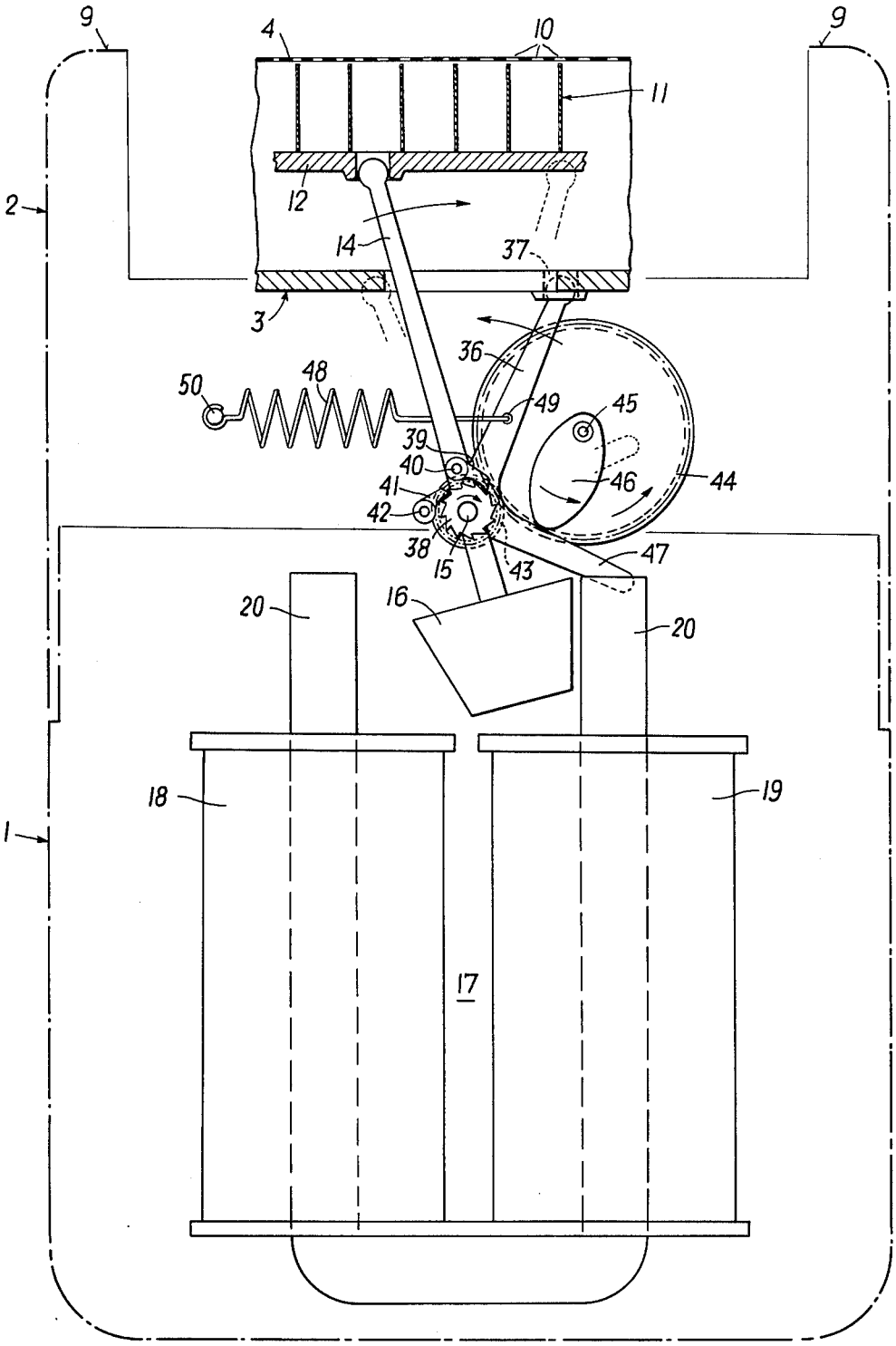
FIG. 2 is a longitudinal section through a further embodiment of an electric razor according to the invention.

In the embodiment shown in FIG. 2 similar parts are provided with the same reference numerals. In this embodiment, a ratchet wheel 38 is rotatably arranged on the axle 15 of the lever 14 and has its teeth cooperating with a latch 39 pivotally supported on an axle pin 40 arranged on the lever 14. During the oscillating movement of the lever 14, the ratchet wheel 38 is moved in clockwise direction by the latch 39. Backward rotation of the ratchet wheel 38 is prevented by a lock pawl 41 which is equally cooperating with the teeth of the ratchet wheel 38 and is pivotally supported on a pin 42 provided within the housing 1.

The ratchet wheel 38 is fixedly connected to a gear wheel 43 equally rotatably supported on the axle 15. The gear wheel 43 is in engagement with a gear wheel 44 having its shaft 45 pivotally supported within the housing 1. A cam 46 is fixedly connected to the gear wheel 44. The cam 46 is cooperating with a protrusion 47 protruding from the lever 36 in a certain angle and being fixedly connected to this lever 36. The lever 36 is, at 49, acted upon by a tension spring 48 being fixed with its other end to the housing 1 at 50. The tension spring 48 causes the protrusion 47 to continuously engage cam 46.

Also in this embodiment, the lever 36, which is in connection with the frame 4 of the shearing comb 3, is oscillating with a lower frequency than does the lever 14 acting on the blade beam 11.

Instead of providing a cam 46 the gear wheel 44 can be provided with a guideway closed upon itself.

A pin protruding from lever 36 or the protrusion 47 of the lever 36, respectively, is engaging such a guideway. Such a guideway equally provokes the lever 36 to oscillate with a lower frequency than the lever 14. With this embodiment, the spring 48 can be ommitted.

In the embodiment shown in FIGS. 3 and 4, a ratchet wheel 52 is provided, the axle 53 of which is rotatably supported within the housing 1 at a position below the pivotal axis 15 of the lever 14. Here again, the ratchet wheel is driven by a latch 54 being pivotally supported on the lever 14 by means of a pin 55. During oscillation of the lever 14 the ratchet wheel 52 is rotated in clockwise direction. For preventing backward rotation of the ratchet wheel 52, there can again be provided a lock pawl pivotally supported within the housing 1.

The ratchet wheel 52 is provided with a laterally protruding pin 56 which is in off-center position relative to the axle 53 of the ratchet wheel and engages a guide slot 57 being in connection with the lever 36. Also in this embodiment, the lever 36 performs an oscillating movement of substantially lower frequency than the frequency of the oscillating movement of the lever 40.

The embodiments of the electric razor according to the invention shown in the FIGS. 1 to 4 can be combined with one another. For example, reduction of the rapid oscillation of the lever 14 to the slower oscillation of the lever 36 can be effected by a ratchet wheel; the conversion of the rotational movement of the ratchet wheel into an oscillating movement of the lever 36, however, can be effected by means of a crank drive.

We claim:

1. An electric razor comprising a housing including a shearing head attached thereto; a shearing comb disposed within the head and having openings permitting hair protruding from a surface to enter into an interior of the comb; a blade beam carrier mounting an elongated blade beam inside of and for cooperation with the comb for severing hair extending through the opening when the blade beam oscillates relative to the comb; drive means disposed within the housing for longitudinally oscillating the blade beam carrier relative to the comb, the drive means including electric motor means and a connecting member driven by the motor means and engaging the blade beam carrier; and shearing comb oscillating means operatively coupled with the connecting member for imparting to the shearing comb a first oscillating motion substantially parallel to the oscillating movement of the blade beam carrier, a second oscillating motion which is transverse to the first oscillating motion of the comb, and a third oscillating motion which lifts the shearing comb off said surface.

2. An electric razor comprising a housing, including a shearing head attached thereto; a shearing comb disposed within the head and having openings permitting hair protruding from a surface to enter into an interior of the comb; a blade beam carrier mounting an elongated blade beam inside of and for cooperation with the comb for severing hair extending through the openings when the blade beam oscillates relative to the comb; drive means disposed within the housing for oscillating the blade beam carrier relative to the comb in a longitudinal direction of the beam, the drive means including a first lever mounted for oscillating movement between first and second terminal positions and electric motor means operatively coupled with the lever for imparting to the lever said oscillating motion and for thereby oscillating the blade beam carrier; and means for oscillating the shearing comb at a frequency which is less than the oscillating frequency of the blade beam carrier, the last mentioned means including means operatively coupled with the lever for transforming the oscillating motion of the lever into a rotating motion, a second lever engaging the shearing comb, means driven by the transforming means for converting rotary motion of the transforming means into an oscillating motion of the second lever, and means for reducing the oscillating frequency of the second lever relative to the oscillating frequency of the first lever.

3. An electric razor according to claim 2 wherein the transforming means and the converting means comprises first and second cranks, a first connecting rod pivotally attached to the first lever and the first crank, a second connecting rod pivotally attached to the second lever and the second crank, first and second shafts secured to the first and second cranks, respectively, and wherein the reducing means comprises a reduction gear train operatively coupling the first and second shafts.

4. An electric razor according to claim 2 wherein the transforming means comprises a rotatably mounted ratchet wheel and latch means pivotally attached to the first lever in operative engagement with the ratchet wheel for transforming pivotal lever motions into a rotating wheel motion, and wherein the converting means is in operative engagement with the ratchet wheel for converting rotary ratchet wheel motion into an oscillating motion of the second lever.

5. An electric razor according to claim 2 wherein the transforming means comprises a rotatably mounted ratchet wheel and a latch pivotally attached to the first lever and in operative engagement with the ratchet wheel for transforming oscillating first lever motions into a rotary ratchet wheel motion, and wherein the converting means includes rotatably mounted wheel means, means for imparting the rotary ratchet wheel motion to the wheel means, and means in operative engagement with the second lever and the wheel means for oscillating the second lever with the wheel means.

6. An electric razor according to claim 2 wherein the transforming means comprises a rotatably mounted ratchet wheel and a latch pivotally carried on the first lever and in operative engagement with the ratchet wheel for transforming oscillating first lever motion into rotary ratchel wheel motion, and wherein the converting means comprises a pin protruding in an axial direction from the ratchet wheel, and slot means carried by the second lever and engaging the pin for oscillating the second lever with the rotary ratchet wheel motion.

7. An electric razor according to claim 4 including locking means cooperating with the ratchet wheel for limiting rotation of the ratchet wheel to rotation in a single direction only.

8. An electric razor according to claim 5 including locking means cooperating with the ratchet wheel for limiting rotation of the ratchet wheel to rotation in a single direction only.

9. An electric razor according to claim 6 including locking means cooperating with the ratchet wheel for limiting rotation of the ratchet wheel to rotation in a single direction only.

10. An electric razor according to claim 2 including a frame mounting the shearing comb and disposed within the shearing head, and guide means operatively coupled with the shearing comb for imparting to the comb a first oscillating motion substantially parallel to the oscillating movement of the blade beam carrier, a second oscillating motion which is transverse to the first oscillating motion of the comb, and a third oscillating motion which lifts the shearing comb off said surface.

11. An electric razor according to claim 10 wherein the guide means comprises aligned pins protruding from the frame and oriented in the direction of the oscillatory motion of the blade beam carrier, and guide members attached to the shearing head for slidably and pivotally supporting the pins.

12. An electric razor according to claim 2 wherein the shearing comb is carried by a frame disposed within the shearing head and includes opposing and cooperating first and second guide surfaces protruding into the interior of the shearing head from the frame and the shearing head, the first and second guide surfaces being arranged so as to impart to the shearing comb in response to longitudinal oscillatory motions of the comb an oscillating motion in a direction transverse to the longitudinal oscillatory motion and an oscillating motion which lifts the shearing comb off said first mentioned surface.

* * * * *